United States Patent [19]

Schwartz

[11] 4,112,484

[45] Sep. 5, 1978

[54] CUP MEMBER FOR A LAMP HAVING SUPPORT MEANS FOR A CHIMNEY AND A SHADE

[76] Inventor: Steven William Schwartz, 38 W. Fourth St., Freeport, N.Y. 11520

[21] Appl. No.: 731,102

[22] Filed: Oct. 8, 1976

[51] Int. Cl.[2] ..... F21L 19/02; F21V 17/00

[52] U.S. Cl. ..... 362/314; 362/441

[58] Field of Search ..... 240/98, 97, 128, 52.6, 240/52 R, 92, 94, 99, 125, 129; 362/312, 313, 314, 412, 442, 441, 433, 445, 315

[56] References Cited

U.S. PATENT DOCUMENTS

| | | | |
|---|---|---|---|
| 688,414 | 12/1901 | Herskovitz | 362/313 |
| 738,999 | 9/1903 | Higgins | 240/98 |
| 804,951 | 11/1905 | Homan | 240/128 |
| 1,036,819 | 8/1912 | Ewing | 362/313 |
| 1,134,574 | 4/1915 | Abramson | 362/358 |
| 2,317,863 | 4/1943 | Sullam | 240/128 |
| 3,166,254 | 1/1965 | Goodman | 240/129 |
| 3,760,177 | 9/1973 | Levy | 362/314 X |

*Primary Examiner*—J. D. Miller
*Assistant Examiner*—Peter S. Wong
*Attorney, Agent, or Firm*—Haseltine, Lake, & Waters

[57] ABSTRACT

A cup member adapted for resting on a base of a lamp and for being sandwiched between the base and a bulb fixture threaded on a stem which passes through an aperture in the cup member. The cup member has a rim with slots formed therein to define flexible fingers which can frictionally receive the lower edge of a chimney. The cup member has integral bushings for removably receiving respective rods connected to a ring member adapted for supporting the outer shade of the lamp.

7 Claims, 4 Drawing Figures

CUP MEMBER FOR A LAMP HAVING SUPPORT MEANS FOR A CHIMNEY AND A SHADE

FIELD OF THE INVENTION

The invention relates to improvements in a lamp construction and particularly to the use of a cup member which serves as a support both for a chimney and a shade of the lamp construction

BACKGROUND

Lamp constructions are well known in which there are employed both a chimney and a shade which are ultimately supported on a base. It has been conventional to employ a metal ring which has an inner bushing and a plurality of rod-like spokes for support of the shade. The bushing loosely receives the stem which passes upwardly through the base and it rests on the base. A separate member is mounted on the stem following the ring and supports the chimney, a bulb fixture being secured to the stem to hold the assembly in place.

A disadvantage of the known constructions is the separate provision of the support ring for the shade and the support member for the chimney.

A further disadvantage is that the mounting of the support ring on the stem beneath the support member is effected at a level below the lower edge of the shade whereby the support ring is visible. Not only is this esthetically undesirable but also it requires some attempt at making the support ring attractive hence increasing its cost.

Yet another disadvantage is that after the support ring has been mounted in place it becomes necessary to completely disassemble the lamp should it be necessary to effect its removal.

A further disadvantage is that in packaging the lamp, the shade and the chimney are separately packaged, and in the remaining subassembly the support ring remains mounted in place and represents the largest diameter element on the subassembly thereby increasing the size of the container therefor.

SUMMARY OF THE INVENTION

An object of the invention is to provide a suitable means for supporting both the chimney and the shade which will obviate the disadvantages noted hereinabove.

More specifically, the invention contemplates the use of a cup means which is detachably mounted on the lamp base and serves for receiving the bulb fixture while including first means for releasably supporting the shade and second means for releasably supporting the chimney within the shade.

According to a particular feature of the invention, the second means comprises a support for yieldably and frictionally supporting the chimney while the first means comprises a plurality of bushings integrally formed with the cup means and adapted for removably receiving a respective rod connected in common to a ring for supporting the shade.

According to a further feature of the invention, the cup means comprises a cup member which can be rested on the base, the support for the chimney being constituted by a plurality of upstanding flexible fingers on the cup member for frictionally receiving the chimney.

According to yet another feature of the invention, the cup member is constituted of a plastic material and has an upstanding annular rim with a plurality of spaced slots formed therein to define said flexible fingers therebetween. The fingers are inclined upwardly and radially outwards and they have inner surfaces with steps thereon defining a cylindrical internal bearing surface for frictionally receiving the chimney.

Preferably, the bushings and slots are three in number and three of the slots are arranged at 120° intervals in the rim for passage of the rods therethrough. The three bushings extend in alignment with the corresponding slots at a level therebelow and the slots which are associated with the bushings extend more deeply in the rim than do the other slots.

The invention will be described in detail hereafter with reference to the attached drawings.

DETAILED DESCRIPTION

Figure 1:
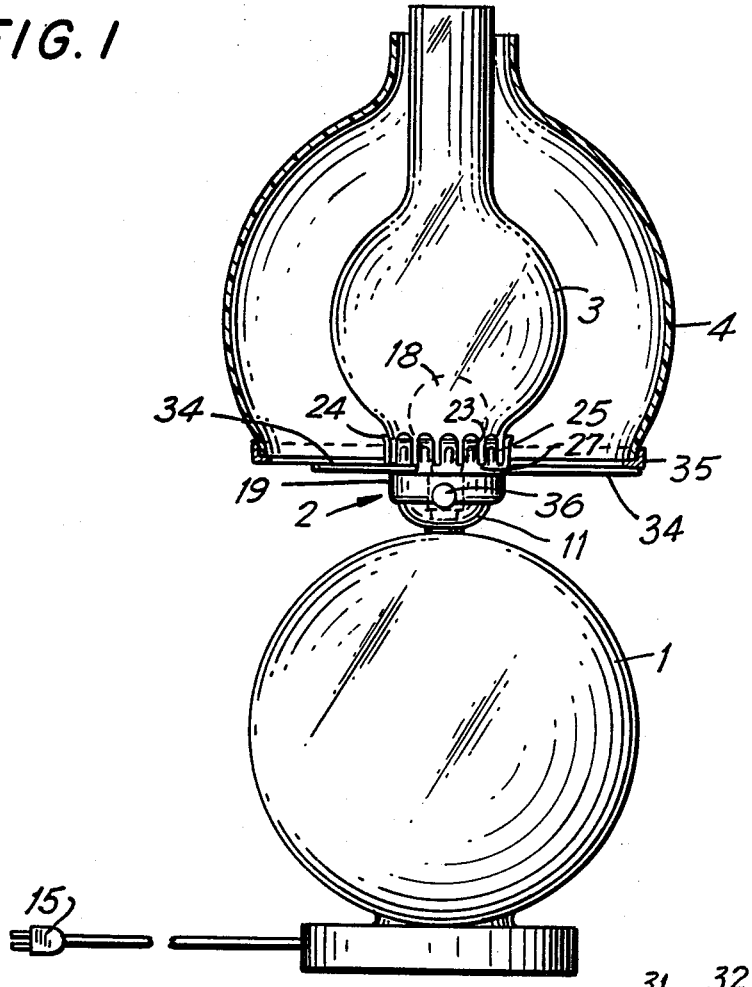
FIG. 1 is an elevational view of a lamp construction employing the cup member of the invention.
Figure 3:
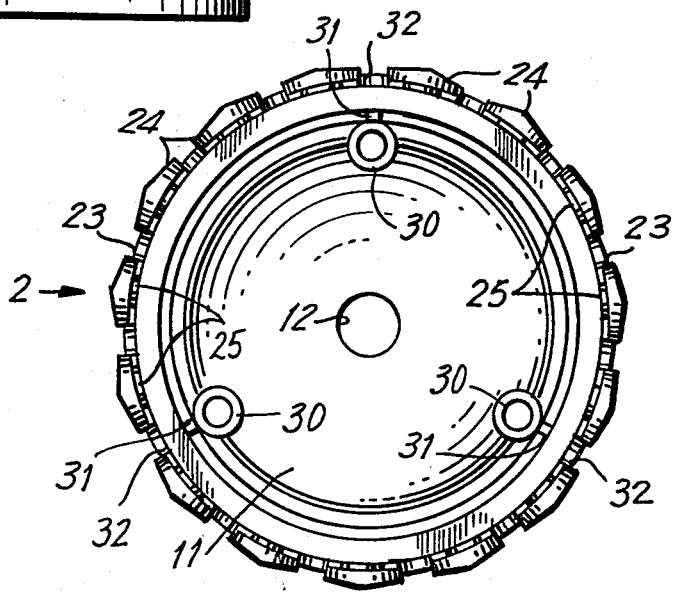
FIG. 3 is a plan view of the cup member.

Referring to FIG. 1 of the drawing, therein is seen a lamp construction of the type known as a student lamp. The construction is also applicable to a victorian lamp and to hurricane lamps. The invention is not only applicable to table lamps, but to ceiling fixtures, floor lamps, pole lamps and the like.

The lamp construction shown in FIG. 1 essentially comprises a base 1, a cup member 2 mounted on the base, a chimney 3 supported by the cup member and shade 4 also supported by the cup member.

The invention is particularly concerned with the construction of the cup member 2 and its capability of supporting both the chimney 3 and the shade 4 in the manner as will be explained later.

Heretofore, it was common to support the shade by means of a member having a small diameter bushing having radial spokes and a ring affixed to the spokes on which the shade can be rested. The bushing was mounted on a stem beneath a conventional metal member which replaced the cup member.

Figure 2:
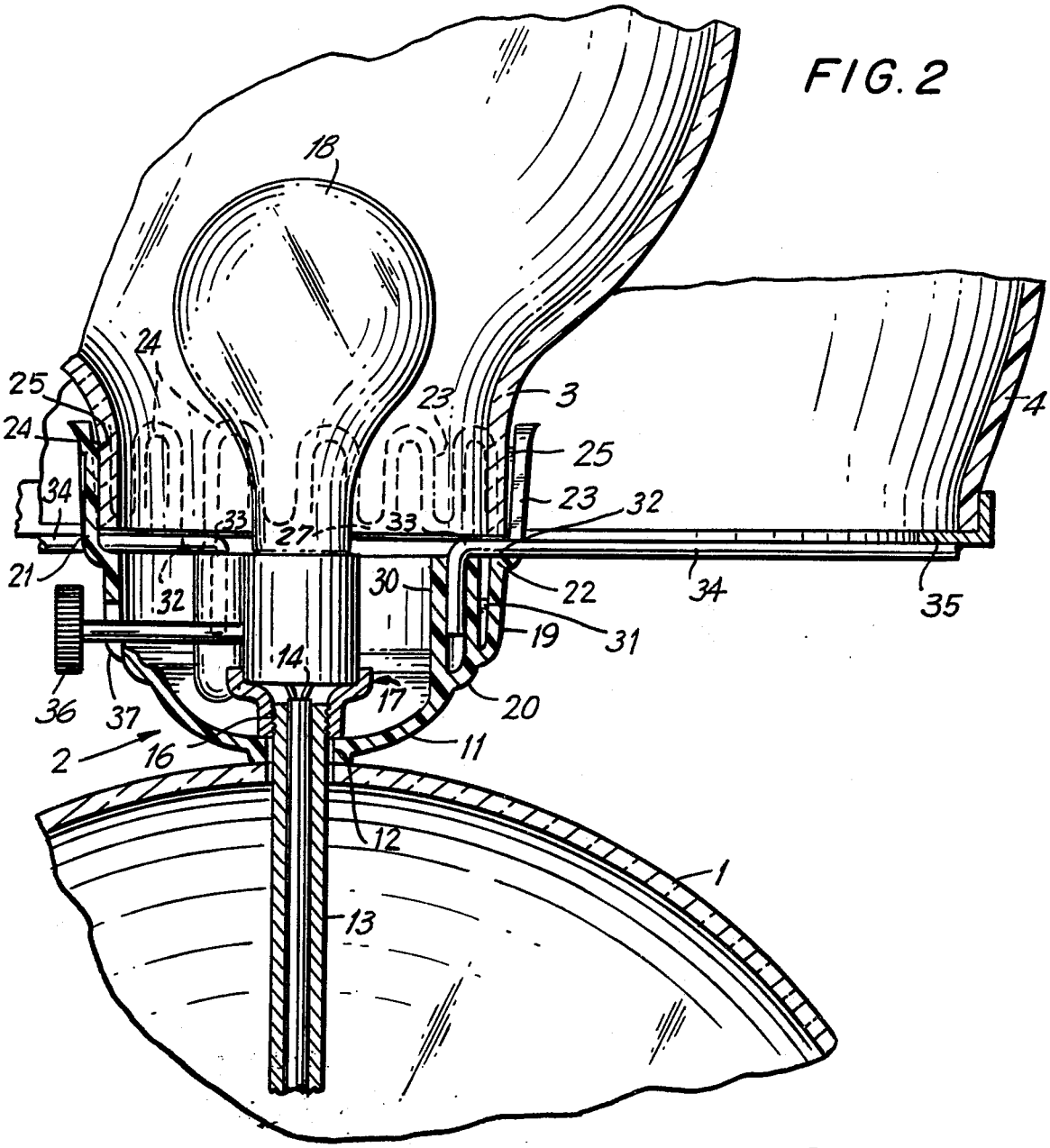
FIG. 2 is an enlarged sectional view of a portion of the construction shown in FIG. 1.

Referring to FIG. 2, the cup member 2 which is formed of a plastic material, comprises a lower dome portion 11 which has an aperture 12 therein for receiving a stem which carries electrical cables 14 therein. The cables extend from the lower end of the base 1 and are connected to a plug 15 which is intended for being introduced into a conventional household socket. At its lower end the stem is secured to the base in conventional fashion. At its upper end the stem 13 is threaded at 16 and carries a bulb fixture 17 which is threaded thereon. The electrical cables 14 are electrically connected to the bulb fixture in conventional manner and the fixture is adapted for receiving a bulb 18 as shown.

The lower dome portion of the cup member rests on the top of base 1 and is sandwiched between the base and the bulb fixture as seen in FIG. 2 with the stem 13 loosely received in hole 12. The dome portion 11 is upwardly extended by a cylindrical portion 19 which forms a shoulder 20 with the dome portion. The cylindrical portion 19 in turn is upwardly extended by a rim 21 which forms a shoulder 22 with cylindrical portion 19. The rim is provided with a plurality of equally spaced slots 23 all around the periphery of the rim.

Fingers 24 are formed between adjacent slots and due to the spacing of the slots and the composition of the cup member, the fingers 24 have a degree of radial flexibility. As seen in FIG. 2, the fingers serve to support the lower edge of chimney 3 by frictional contact therewith. The fingers are inclined upwardly and outwardly and to provide a cylindrical support surface for the lower edge of chimney 3, integral wedge-shaped steps 25 are formed on the inner surface of the fingers. These steps collectively define a cylindrical receiving surface for the lower edge of the chimney 3 and preferably the diameter of the cylindrical receiving surface is slightly less than that of the diameter of the lower edge of chimney 3 so that there will be a frictional interfit between the chimney and the fingers so as to provide a tight grip of the chimney.

Figure 4:
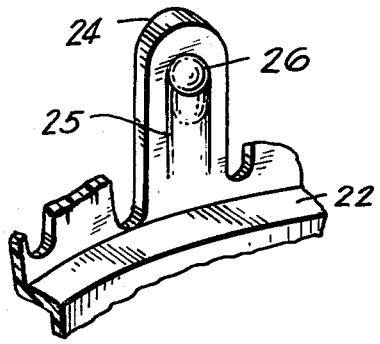
FIG. 4 is a perspective view showing a portion of a modified rim of the cup member.

FIG. 4 shows a modification wherein rounded beads 26 are formed at the inner surface of steps 25 at the upper ends of such steps. Each bead provides a resilient point contact with the outer surface of the chimney and the beads collectively define a circular contact surface with the chimney and provide intensified resilient contact therewith.

It is to be noted that slots 23 extend only partially in the height of rim 21 and the lower ends of the slots 23 are spaced from shoulder 22 to form an annular band 27 between the fingers 24 and the shoulder 22. The presence of the annular band 27 permits return of the fingers to their initial position by resilient action while providing integral connection between the fingers to minimize breakage thereof. In this regard, the cup member is preferably made of a high impact plastic such as high impact polystyrene.

In order to provide removable support of the shade 4 from the cup member 2, the cup member is formed with three integral bushings 30 which extend upwardly from the lower dome portion 11 at a position radially spaced from the inside surface of cylindrical portion 19. Integral ribs 31 are formed with the bushings 30 and shoulders 20 to rigidify the bushings. The bushings 30 are aligned with respective slots 32. These slots extend more deeply in the rim than slots 23 and terminate at the shoulder 22. The bushings are uniformly distributed at 120° intervals around the periphery of the cup member. Each bushing is intended to receive a bent end 33 of a respective rod 34, said rods passing through the respective slots 32. The rods are connected to a common ring 35 on which the shade 4 can be supported. An on-off switch 36 of the bulb fixtures extends through an opening 37 formed in the cylindrical portion 19.

It is seen from the above construction, that in order to disassemble the support means for the shade it is sufficient merely to remove the shade and chimney and to extract the rods 34 from the bushings 30 and supporting slots 32. Reversely, in the course of assembling the lamp, the cup member can be assembled with the base and the bulb fixture, and the lamp and chimney can be subsequently assembled on the cup member after prior installation of the rods. In contrast, in the conventional constructions, the inner circular bushing with the spokes and the supporting ring had to be mounted on the stem 13 below the cup member prior to the attachment of the bulb fixture to the stem. This necessitated the use of a container of sufficient size to accommodate the diameter of the supporting ring. If the ring is packaged separately with the shade in the known construction it becomes necessary for the consumer to make the electrical connection between the bulb fixture and the electrical cables and to affix the bulb fixture onto the stem. For ready made-up lamp constructions this is undesiraable. Furthermore, due to the positioning of the bushing at a level below the cup member in the conventional construction the spokes become visible and become an element in the appearance of the lamp. By use of the cup member of the invention, the rods 34 sre substantially hidden and hence do not present an important element in the appearance of the lamp.

From the above it is deemed evident that the cup member of the invention comprises first means in the form of the bushings 30 and rods 34 for releasably supporting the shade and second means inclusive of the upstanding rim 21 with the fingers 24 formed therein for releasably supporting the chimney within the shade.

Moreover, even if the lamp should be employed without a shade, the construction of the cup member from high impact plastic with the upstanding fingers 24 and annular band 27 provides a highly effective resilient support means for the chimney.

Although the invention has been described in relation to one embodiment thereof, numerous modifications and variations will become evident to those skilled in the art without departing from the scope and spirit of the invention as defined in the attached claims.

What is claimed is:

1. In a lamp construction having a base, a chimney, a bulb fixture, and a shade, an improvement comprising a cup member of plastic material detachably restable on the base for receiving the bulb fixture, said cup member including an upstanding annular rim having a plurality of spaced slots therein defining a plurality of upstanding flexible fingers between said slots for frictionally receiving the chimney, and a plurality of upstanding bushings integral with said cup member, said bushings being hollow and having upper ends disposed below the upper ends of said flexible fingers, said bushings being angularly disposed in alignment with selected of said slots, and a plurality of rods having bent ends removably engaged in said bushings, said rods extending from said bent ends in the bushings through the aligned slots radially outwards from the cup member, said rods having ends remote from said cup member for supporting said shade, said cup member comprising a lower dome portion which rests on said base in inverted fahion, a cylindrical portion extending upwardly from said dome portion and having a larger diameter than said dome portion with a step formed between said dome portion and said cylindrical portion, said rim extending upwardly from said cylindrical portion and having a larger diameter than said cylindrical portion with a second step between the rim and the cylindrical portion, said bushings extending upwardly from said dome portion to a spaced location inwards of said cylindrical portion, said upper ends of the bushings being disposed at a level below the slots, said selected slots for the passage of the rods extending in the rim to the level of said second step, the other slots extending less deeply in the rim to define a lower circumferential band above said second step joining said fingers to said second step.

2. The improvement as claimed in claim 1 where said rods extend from said bent ends horizontally through said slots.

3. The improvement as claimed in claim 1 where said fingers are inclined upwardly and radially outwards.

4. The improvement as claimed in claim 3 wherein said fingers have inner surfaces with wedge-shaped steps thereon, said steps on the figers defining a cylindrical internal bearing surface for frictionally receiving the chimney.

5. The improvement as claimed in claim 1 wherein said cup member is constituted of a plastic material.

6. The improvement as claimed in claim 1 wherein said dome portion is sandwiches between said bulb fixture and said base.

7. The improvement as claimed in claim 1 wherein the portion of the rods extending from the bent ends pass above said second step in proximity thereto.

* * * * *